US009879905B2

(12) United States Patent
Wang

(10) Patent No.: US 9,879,905 B2
(45) Date of Patent: Jan. 30, 2018

(54) NATURAL GAS ISOBARIC LIQUEFACTION APPARATUS

(71) Applicant: NANJING RECLAIMER ENVIRONMENTAL TEKNIK CO., LTD., Nanjing, Jiangsu (CN)

(72) Inventor: Haibo Wang, Jiangsu (CN)

(73) Assignee: NANJING RECLAIMER ENVIRONMENTAL TEKNIK CO., LTD., Nanjing, Jiangsu (CN)

( * ) Notice: Subject to any disclaimer, the term of this patent is extended or adjusted under 35 U.S.C. 154(b) by 122 days.

(21) Appl. No.: 14/763,760

(22) PCT Filed: Jan. 24, 2014

(86) PCT No.: PCT/CN2014/071402

§ 371 (c)(1),
(2) Date: Jul. 27, 2015

(87) PCT Pub. No.: WO2014/114264

PCT Pub. Date: Jul. 31, 2014

(65) Prior Publication Data

US 2015/0362250 A1 Dec. 17, 2015

(30) Foreign Application Priority Data

Jan. 27, 2013 (CN) ..... 2013 1 0029518

(51) Int. Cl.

| | |
|---|---|
| ***F25J 1/02*** | (2006.01) |
| ***F25J 1/00*** | (2006.01) |
| ***F25J 3/02*** | (2006.01) |

(52) U.S. Cl.

CPC ..... *F25J 1/0022* (2013.01); *F25J 3/0209* (2013.01); *F25J 3/0233* (2013.01); *F25J 3/0257* (2013.01);

(Continued)

(58) Field of Classification Search

CPC ..... F25J 1/0022; F25J 3/0209; F25J 3/0257; F25J 3/0233; F25J 2200/06; F25J 2215/60

See application file for complete search history.

(56) References Cited

U.S. PATENT DOCUMENTS

| | | | | |
|---|---|---|---|---|
| 2008/0141711 | A1 | 6/2008 | Roberts et al. | |
| 2010/0071409 | A1* | 3/2010 | Kaart | F25J 1/0214 62/612 |
| 2011/0168377 | A1* | 7/2011 | Alers | F25B 9/006 165/200 |

FOREIGN PATENT DOCUMENTS

| | | | |
|---|---|---|---|
| CN | 1293232 | A | 5/2001 |
| CN | 203224099 | U | 10/2013 |
| FR | 2965608 | A1 | 4/2012 |

OTHER PUBLICATIONS

CN1293232 Translation.*

* cited by examiner

*Primary Examiner* — Frantz Jules
*Assistant Examiner* — Brian King
(74) *Attorney, Agent, or Firm* — Novick, Kim & Lee, PLLC; Allen Xue

(57) ABSTRACT

This invention is about a natural gas isobaric liquefaction apparatus, which is based on the Rankine cycle system of similar thermal energy power circulation apparatus at cryogenic side, a cryogenic liquid pump is used to input power and the refrigerating media makes up cold to the natural gas liquefying apparatus, so as to realize the isobaric liquefaction of natural gas. The natural gas liquefying apparatus of this invention can save energy by over 30% as compared with the traditional advanced apparatus with the identical refrigerating capacity, therefore it constitutes a breakthrough to the traditional natural gas liquefaction technology, with (Continued)

substantial economic, social and environmental protection benefits.

10 Claims, 6 Drawing Sheets

(52) U.S. Cl.
CPC ..... *F25J 2200/06* (2013.01); *F25J 2200/20* (2013.01); *F25J 2205/04* (2013.01); *F25J 2210/42* (2013.01); *F25J 2215/04* (2013.01); *F25J 2220/64* (2013.01); *F25J 2235/42* (2013.01); *F25J 2240/12* (2013.01); *F25J 2240/90* (2013.01); *F25J 2270/904* (2013.01)

NATURAL GAS ISOBARIC LIQUEFACTION APPARATUS

TECHNICAL FIELD

This invention is about a natural gas isobaric liquefaction apparatus, specifically in the technical field of cryogenic refrigeration.

BACKGROUND OF THE INVENTION

Natural gas is a high quality and clean petrochemical energy, with a quite important position in national economy. The liquefaction and storage of natural gas is a critical technology in its development and utilization, it has become an industry both at home and overseas, and grows at an average annual rate of 8%, in recent years, it has been growing quite rapidly in the energy consumption pattern of China. The technology to liquefy natural gas has become a high technology, being attached with importance by more and more scientific and technological sectors.

It is expected that by the mid of this century, if China consumes natural gas of $5000*10^8$ $m^3/a$, including import of LNG$1000*10^8$ $m^3/a$ (equivalent the present import of Japan), the usable cold energy is $257*10^8$ kWh/a, equivalent to the annual power generation amount of a power plant of $600*10^4$ kW. Therefore, it is worth our in-depth consideration on how to realize breakthroughs in aspects of technology, management mechanism and market operation for LNG, to substantially reduce the energy consumption for LNG, push forward rapid development of large scale cold energy industrial chain including air separation and gasification of coal with enriched air for huge energy conservation and economic benefit, so as to make contribution to the full realization of cyclic economy and saving economy in China. In the meantime, the rapid development and transition of Chinese economy has determined the absolute necessity of large-scale use of LNG, and also provided a huge user market.

Traditional natural gas liquefaction is mainly based on the following three processes:

1. Cascade liquefying process (also referred to as step liquefaction process, overlapped liquefying process or serial vaporization and condensation liquefying process), mainly applied in natural gas liquefying apparatus carrying basic loads;

2. Mixed refrigerant liquefying process: the so-called MRC liquefying process, is a process in which a medium of mixed refrigerant with multi-components including hydrocarbon compound of C1 to C5 and $N_2$, is condensed, vaporized and throttle expanded to obtain a certain refrigerating capacity at different temperature level so as to refrigerate and liquefy natural gas step by step. MRC has achieved the purpose similar to cascade liquefying process, and also overcome its disadvantage of complicated system. Since the 1980s, almost all newly built and expanded natural gas liquefaction apparatus for basic loads are based on the liquefying process with propane precooling mixed refrigerant;

3. Liquefying process with expander: this process is based on the Claude cycle of refrigerant in a turbine expander, to realize liquefaction of natural gas. When the gas expands and makes work in an expander, the temperature is lowered and power recovered. Depending on different refrigerant, it can be classified as nitrogen expansion liquefying process and natural gas expansion liquefying process. These processes have the advantages: (1) simple process, flexible regulation, reliable working, easy startup and operation, and convenient maintenance; and (2) with the natural gas itself used as medium, it can save the expense of production, transport and storage of refrigerant. The disadvantages are: (1) all gas streams to the apparatus requires in-depth drying; (2) the reflux pressure is low, the area of heat exchange is large and the input of equipment metal is high; (3) it is restricted by the number of LP users; (4) the liquefaction rate is low, if re-circulation is required, the power consumption will increase greatly when additional circulation compressors are used. A liquefying process with expander is easy to operate with moderate investment, and is particularly suitable to peak regulation type natural gas liquefaction apparatus with fairly low capacity.

FIG. 1 is a schematic diagram of cascade natural gas liquefying process.

FIG. 2 is a schematic diagram of APCI propane precooling mixed refrigerant liquefying process.

FIG. 3 shows the natural gas expansion liquefying process, in which: 301—dehydrating agent, 302—carbon dioxide removal column, 303—water cooler, 304—returns to the gas compressor, 305, 306, 307—heat exchangers, 308—subcooler, 309—tank, 310—expander, 311—compressor.

FIG. 4 shows the nitrogen expansion liquefying process, in which: 401—pre-treatment apparatus, 402, 404, 405—heat exchanger, 403—heavy hydrocarbon separator, 406—nitrogen stripper, 407—turbine expander, 408—nitrogen-methane separating column, 409—circulation compressor.

FIG. 5 is a schematic diagram of natural gas expansion liquefying process with propane precooling, in which: 501, 503, 505, 506, 507—heat exchangers, 502, 504—propane heat exchangers, 508—water cooler, 509—compressor, 510—braking compressor, 512, 513, 514—gas-liquid separator.

The design of the afore-said traditional natural gas liquefying processes is mainly based on the theoretical foundation of thermodynamics, Carnot reverse cycle of identical temperature difference is used to analyze the natural gas liquefying process, the economic indicator of the cycle is the refrigeration coefficient, or the ratio of obtained gain to the cost of consumption, and also, of all refrigerating cycles between atmospheric environment with temperature of $T_0$ and low temperature heat source with temperature of Tc (such as refrigeration store), the reverse Carnot cycle has the highest refrigeration coefficient:

$$\varepsilon_c = (COP)_{R,C} = \frac{q_2}{w_0} = \frac{T_c}{T_0 - T_c} \tag{1}$$

In the formula above, $\epsilon_c$ is the refrigeration coefficient, $q_2$ refrigerating capacity of the cycle, and $w_0$ the net work consumed by the cycle.

The actual cycle efficiency is usually described by the ratio of refrigeration coefficient of actual cycle and theoretical cycling refrigeration coefficient, however, its theoretical basis is cyclic analysis of refrigerating process with Carnot reverse cycle.

In fact, in his thesis "Reflections on the Motive Power of Heat", Carnot concluded that: of all heat engines working between two constant temperature heat sources of different temperatures, the reversible heat engine has the highest efficiency." This was later referred to as the Carnot theorem, after rearranging with the ideal gas state equation, the thermal efficiency of Carnot cycle obtained is:

$$\eta_c = 1 - \frac{T_2}{T_1} \quad (2)$$

In Formula (2), temperature $T_1$ of the high temperature heat source and temperature $T_2$ of low temperature heat source are both higher than the atmosphere ambient temperature $T_0$, and the following important conclusions can be obtained:

1) The thermal efficiency of Carnot cycle only depends on the temperature of high temperature heat source and low temperature heat source, or the temperature at which the media absorbs heat and release heat, therefore the thermal efficiency can be increased by increasing $T_1$ and $T_2$.

2) The thermal efficiency of Carnot cycle can only be less than 1, and can never be equal to 1, because it is not possible to realize $T_1=\infty$ or $T_2=0$. This means that a cyclic engine, even under an ideal condition, cannot convert all thermal energy into mechanical energy, of course, it is even less possible that the thermal efficiency is greater than 1.

3) When $T_1=T_2$, the thermal efficiency of the cycle is equal to 0, it indicates that in a system of balanced temperature, it is not possible to convert heat energy into mechanical energy, heat energy can produce power only with a certain temperature difference as a thermodynamic condition, therefore it has verified that it is not possible to build a machine to make continuous power with a single heat source, or the perpetual motion machine of the second kind does not exist.

4) Carnot cycle and its thermal efficiency formula are of important significance in the development of thermodynamics. First, it laid the theoretical foundation for the second law of thermodynamics; secondly, the research of Carnot cycle made clear the direction to raise the efficiency of various heat power engines, i.e. increasing the heat absorbing temperature of media and lowering the heat release temperature of media as much as possible, so that the heat is release at the lowest temperature that can be naturally obtained, or at the atmospheric temperature. The method mentioned in Carnot cycle to increase the gas heat absorbing temperature by adiabatic compression is still a general practice in heat engines with gas as media today.

5) The limit point of Carnot cycle is atmospheric ambient temperature, and for refrigerating process cycles below ambient temperature, Carnot cycle has provided no definite answer.

However, the basic theory of thermodynamics cannot make simple, clear and intuitional explanation of the cycling process of natural gas liquefying apparatus, to produce 1 ton of LNG, the power consumption of equipment and utilities is about 850 kWh, which means very high energy consumption in the process.

Einstein commented the classical thermodynamics this way: "A theory will give deeper impression to the people with simpler prerequisite, more involvement and wider scope of application." In the exploration of basic theory in the refrigeration field, this point should be inherited and carried forward.

Therefore, it has become a difficult issue in the research of natural gas liquefaction technical field to research on the natural gas liquefaction cycles, to really find the theoretical foundation for the refrigerating apparatus cycle and the correct direction to improve the process, and to organize new natural gas liquefying apparatus process on this foundation and substantially reduce the energy consumption of natural gas liquefying apparatus.

Content of the Invention

The purpose of this invention is to improve the theoretical analysis of Carnot theorem when applied to natural gas liquefying apparatus cycle, propose the new refrigerating theory corresponding to thermodynamic theory, i.e. the cold dynamics theory, and also propose a new natural gas isobaric liquefaction apparatus designed by applying this principle, to overcome the disadvantages of traditional natural gas liquefying process such as complicated process, high energy consumption and massive utility facilities such as circulating cooling water system, while retaining and further developing the advantages such as liquefying process with expander, so that energy consumption can be substantially cut by over 30%, and also realize isobaric condensation of natural gas, and also greatly reducing equipment maintenance and materials backup, so as to realize the transformation of natural gas liquefaction technology.

Corresponding to the traditional scope of thermodynamics, the basic concept of cold dynamics is proposed: any environment below the atmospheric ambient temperature is referred to as a cold source, corresponding to heat source above the ambient temperature, and corresponding to heat energy and heat, the corresponding concepts of cold energy and cold are proposed; the said refrigerating apparatus refers to that consuming mechanical power to realize transfer of cold energy from atmospheric environment to cryogenic cold source or from a cold source of low temperature to that of lower temperature. In the transfer of cold energy, some substance is required as working media in the refrigerating apparatus, and it is referred to as refrigerating media.

In the refrigerating process, the transfer of cold energy follows the energy conversion and conservation law.

To describe the cold transfer direction, conditions and limit in the refrigerating process, the second law of cold dynamics is proposed: the essence of the second law of cold dynamics is identical to that of the second law of thermodynamics, and it also follows the "energy quality declining principle", i.e. cold energy of different forms differs in "quality" in the ability to convert into power; and even the cold energy of the same form also has different ability of conversion at different status of existence. All actual processes of cold energy transfer are always in the direction of energy quality declination, and all cold energy spontaneously converts in the direction of atmospheric environment. The process to increase the quality of cold energy cannot perform automatically and independently, a process to increase energy quality is surely accompanied by another process of energy quality declination, and this energy quality declination process is the necessary compensating condition to realize the process to increase energy quality, that is, the process to increase energy quality is realized at the cost of energy quality declination as compensation. In the actual process, the energy quality declination process, as a cost, must be sufficient to compensate for the process to increase the energy quality, so as to meet the general law that the total energy quality must certainly decline. Therefore, with the given compensation condition for energy quality declination, the process to increase the energy quality surely has a highest theoretical limit. This theoretical limit can be reached only under the complete reversible ideal condition, in this case, the energy quality increase value is just equal to the compensation value for energy quality declination, so that the total energy quality remains unchanged. This shows that a reversible process is a pure and ideal process of energy quality conservation, in an irreversible process, the total energy quality must surely decline, and in no case it is possible to realize a process to increase the total energy quality in an isolated system. This is the physical connotation of the energy quality declining principle, the essence of the second law of cold dynamics, and also the essence of the second law of thermodynamics, and it reveals the objective law of the direction, conditions and limit of process that must be followed by all macroscopic processes.

The basic formula describing the second law of cold dynamics is:

$$\eta_c = 1 - \frac{T_{c2}}{T_{c1}} \tag{3}$$

In Formula (3), $Tc2<Tc1<T_0$, $T_0$ is the ambient temperature, all based on Kelvin temperature scale.

With respect to the ambient temperature $T_0$, the maximum cold efficiency of the cold source at Tc1 and Tc2 is:

$$\eta_c = 1 - \frac{T_{c1}}{T_0} \tag{4}$$

$$\eta_c = 1 - \frac{T_{c2}}{T_0} \tag{5}$$

Suppose $q_2$ is the refrigerating capacity of the cycle, and $w_0$ the net power consumed by the cycle, then when the cold source temperature is Tc1:

$$w_0 = \left(1 - \frac{T_{c1}}{T_0}\right)q_2 \tag{6}$$

Similarly, when the cold source temperature is Tc2

$$w_0 = \left(1 - \frac{T_{c2}}{T_0}\right)q_2 \tag{7}$$

It is not difficult to see from Formulas (4) to (7) that, the efficiency of the cold dynamics is between 0 and 1, and due to unavoidable irreversibility in the actual process, the refrigerating cycle efficiency is always less than 1;

When the ambient temperature $T_0$ is determined, the lower cold source temperature, the more refrigerating capacity can be obtained with the same amount of power input from that cold source, and this has pointed out the direction for building new natural gas liquefying apparatus processes.

It should be noted that:

(1) The cold is transferred spontaneously from the cryogenic cold source to ambient temperature;

(2) It is not possible to transfer cold from a cryogenic cold source to a cold source of lower temperature without causing other change;

(3) When the cold is transferred from a cryogenic cold source to the environment, the power exchanged with the outside is $w_0$, which includes the useless work $p_0(V_0-V_c)$ made to the environment, $p_0$ is the atmospheric pressure, $V_0$ the volume at ambient temperature, Vc the volume at cold source temperature, and the maximum reversible useful work made is:

$$(W_n)_{max} = W_0 - p_0(V_0 - V_c) = \left(1 - \frac{Tc}{To}\right)Q_0 - p_0(V_0 - V_c)$$

(4) When the cold is transferred from a cryogenic cold source to the environment, the useless energy transferred to the environment is:

$$E_{useless} = \frac{Tc}{To}Q_0$$

The useless work transferred to the environment is: $p_0(V_0-V_c)$

Corresponding to the useful energy "Yong" and useless energy "Jin" of heat quantity, and with the meanings of heat for fire and cold for water, the useful energy of cold energy is named as "cold energy lian", and the useless energy of cold energy transferred to the environment is named as "cold energy jin", and this "jin" is to water.

(5) When cold energy is transferred to environment, the best form of making work to the outside is using a thermoelectric generator of Seebeck effect, generator, or cold power generator;

(6) In cold dynamics, the energy must and also inevitably follow the energy conversion and conservation law;

(7) With reference to the conception of finite time thermodynamics, it is possible to develop the basic theory of finite time cold dynamics;

(8) The quality of cold energy cannot be assessed by separating it from the specific environment;

(9) Cold dynamics and thermodynamics are two branches of the energetics, and are a unity of opposites: in a cryogenic refrigerating cycle, while following the second law of cold dynamics, the cycle process of refrigerant media formed in the cryogenic environment also follows the Rankine cycle, so it comes back to the Carnot law, just in line with the principle of the Chinese traditional aesthetics that yin and yang mutually complement.

It can be seen from the view above that, the supposed cold dynamics has a theoretical framework system symmetric to thermodynamics, so it complies with the basic principle of scientific aesthetics, or the principle of opposite and complementary symmetry.

On the basis of the afore-said cold dynamics basic principle, this invention has proposed a process organization different from the traditional natural gas liquefying apparatus, to realize isobaric liquefaction of natural gas with low energy consumption, so that the energy consumption of the natural gas liquefying apparatus can be effectively reduced, and the specific power consumption of natural gas is reduced to about 0.24 kW·h/kg.

The purpose of this invention is realized with the following measures:

A natural gas isobaric liquefying apparatus, which is comprised of the natural gas pretreatment system, liquefying system, cold makeup system, storage system, control system and fire fighting system, this invention only presents the schematic diagram of the most important part, or the liquefying process, the part not described in detail will be configured according to the traditional mature technologies, and the process steps to realize natural gas isobaric liquefaction are as follows:

(1) The raw natural gas 601 flows via the pre-treatment apparatus 602 to remove moisture and carbon dioxide, enters the cold exchanger 603 and heavy hydrocarbon separator 604 to separate the liquid heavy hydrocarbon component 605, and then passes through cold exchanger 606 to become the precooled column feeding raw gas 607;

(2) The precooled column feeding raw gas 607 enters the lower column 608, flows via condensing evaporator 609 to produce supercooled methane liquid, which flows back for rectification and isobaric condensation to produce liquefied natural gas 611 or LNG, the LNG is sent to LNG tank 612;

(3) In the condensing evaporator, the pure methane liquid 613 produced from isobaric condensation is led to the liquid pure methane tank 614;

(4) The cold makeup system of the said apparatus refers to the setup in which the liquid refrigerant 620 from refrigerant tank 619 is made into a refrigerant gas-liquid mixture 622 via the cryogenic liquid pump 621 and cold regenerator 618, and enters the upper column 610, the condensing evaporator 609 condenses the methane gas in the lower column to produce liquid methane, the column outflow cryogenic refrigerant 615 from the upper column 610 flows via the cold exchanger 606 and cold exchanger 603 to cool down the raw natural gas 601, to form the refrigerant superheated vapor 616, which flows via the expander 617 to reduce pressure and temperature, and returns via cold regenerator 618 and throttle valve 623, to the refrigerant tank 619, the cold quantity required by the natural gas liquefying system is made up via condensing evaporator 609, cold exchanger 606 and cold exchanger 603, so as to form the cold dynamic cycle circuit of the refrigerant; the pressure of the cold makeup system can be conveniently regulated via throttle valve 623.

The braking equipment 624 of the said expander 617 refers to fan, motor, hydraulic pump or gas compressor.

The methane from the top of lower column 608 can also be directly led into upper column 610 for washing by liquid nitrogen to produce liquid pure methane, which can be directed out from the bottom of upper column 610 and sent to liquid pure methane tank 614.

The said isobaric separation refers to the process that the raw natural gas entering the natural gas liquefying system needs not to be liquefied with throttling pressure reduction as in the traditional natural gas liquefying process, the incoming raw natural gas 601 is only subjected to resistance loss in the equipment and pipes along the way, so it can be taken as an isobaric liquefying process.

The said liquefying system consists of the lower column 608, condensing evaporator 609 and upper column 610, in an integrated or separated structure.

The said refrigerant has a boiling point lower than or equal to that of methane under standard atmospheric pressure, and is a mixture formed by one or a number of gases including without limitation methane, nitrogen, argon, helium and hydrogen, if safety can be ensured, gaseous or liquid hydrogen can also be used, with preference as gaseous nitrogen.

The said refrigerant tank 619 is provided with necessary thermal and cold insulation, such as thermal isolated vacuum container, and insulation materials such as pearlite.

The said cold exchanger 606, cold exchanger 603 and cold regenerator 618 are tube-shell type, plate-fin, micro channel or other types of cold exchanger, their structure and cold exchange elements are identical to the tube-shell type heat exchanger, plate-fin heat exchanger, micro channel heat exchanger in the traditional natural gas liquefying process, the more precise names are used in their place only for the purpose of corresponding to the refrigerating system.

One or a number of the said cold exchanger 603, cold exchanger 606, separator 604 and cold regenerator 618 can be provided.

The equipment and their backup systems, pipes, instruments, valves, cold insulation and bypass facilities with regulation functions not described in this invention shall be configured with mature technologies of generally known traditional natural gas liquefying systems.

Safety and regulation and control facilities associated with the natural gas liquefying apparatus of this invention are provided, so that the apparatus can operate economically and safely with high thermal efficiency, to achieve the goal of energy conservation, consumption reduction and environmental protection.

The apparatus of this invention is also applicable to liquefaction of other gases, and boiling point under standard atmospheric pressure of the refrigerant used is lower than or equal to that of the corresponding gas to be liquefied.

This invention has the following advantages as compared with existing technologies:

1. Substantial energy conservation effect: the circulating gas compressor in the traditional natural gas liquefying system cycle is cancelled, by using the property of liquid as an almost incompressible fluid, the cryogenic liquid circulating pump is used for boosted cold makeup, to realize the isobaric liquefaction of natural gas, it can effectively increase the efficiency of refrigerating cycle, and compared with a traditional natural gas liquefying apparatus, with the same refrigerating capacity, energy can be saved by over 30%, and compared with the traditional advanced processes, at least 200 kWh of power can be saved per each ton of liquefied natural gas.

2. LNG or liquid pure methane produced by isobaric condensation, can save the electric power consumed in the traditional boosting process for LNG or pure liquid methane.

3. The gas compression work in the traditional natural gas liquefying process can be saved by liquefying natural gas at low pressure and then increasing pressure for liquefied natural gas, so that power consumption of the utilities associated with the natural gas liquefying system can be cut by over 80%.

4. Simpler process flow setup can bring into full play the potential of the liquefying system, and the operation can be more flexible and more convenient in regulation.

5. The equipment and materials inventory can be substantially reduced.

6. It can fully replace the traditional mainstream natural gas liquefying apparatus of basic loads such as propane precooling mixed refrigerant liquefying process, becoming the prevailing process for natural gas liquefying apparatus of both base type and peak regulation type.

DESCRIPTION OF FIGURES

In FIG. 3: 301—dehydrating agent, 302—carbon dioxide removal column, 303—water cooler, 304—returns to the gas compressor, 305, 306, 307—heat exchangers, 308—subcooler, 309—tank, 310—expander, 311—compressor.

In FIG. 4: 401—pre-treatment apparatus, 402, 404, 405—heat exchanger, 403—heavy hydrocarbon separator, 406—nitrogen stripper, 407—turbine expander, 408—nitrogen-methane separating column, 409—circulation compressor.

In FIG. 5: 501, 503, 505, 506, 507—heat exchangers, 502, 504—propane heat exchangers, 508—water cooler, 509—compressor, 510—braking compressor, 512, 513, 514—gas-liquid separators.

In FIG. 6: 601—raw natural gas, 602—pretreatment apparatus, 603—cold exchanger, 604—heavy hydrocarbon separator, 605—liquid heavy hydrocarbon component, 606—cold exchanger, 607—precooled column feeding raw gas, 608—lower column, 609—condensing evaporator, 610—upper column, 611—LNG, 612—LNG tank, 613—pure liquid methane, 614—pure liquid methane tank, 615—column outflow cryogenic refrigerant, 616—refrigerant superheated vapor, 617—expander, 618—cold regenerator, 619—refrigerant tank, 620—liquid refrigerant, 621—cryogenic liquid pump, 622—refrigerant gas-liquid mixture, 623—throttle valve, 624—braking equipment.

EMBODIMENTS

In the following, this invention is further described in detail in conjunction with figures and embodiments.

Embodiment 1

Figure 1:
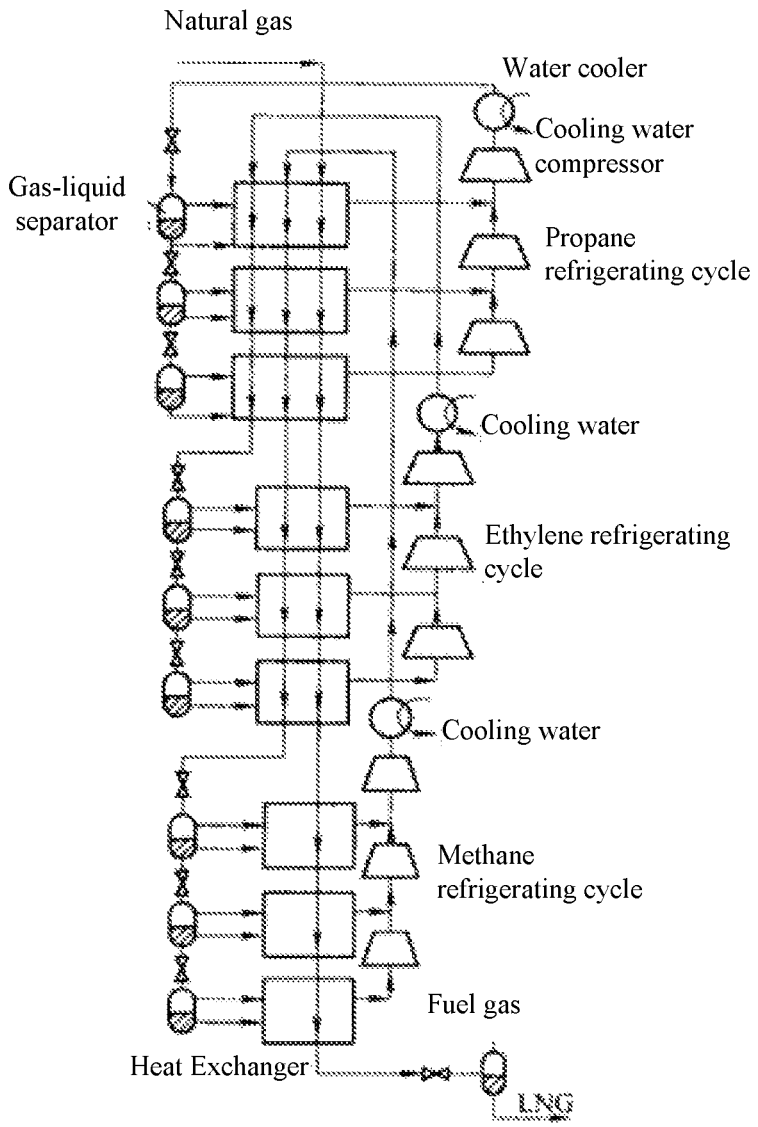
Prior Art Figure 1
FIG. 1 is a schematic diagram of cascade natural gas liquefying process.
Figure 2:
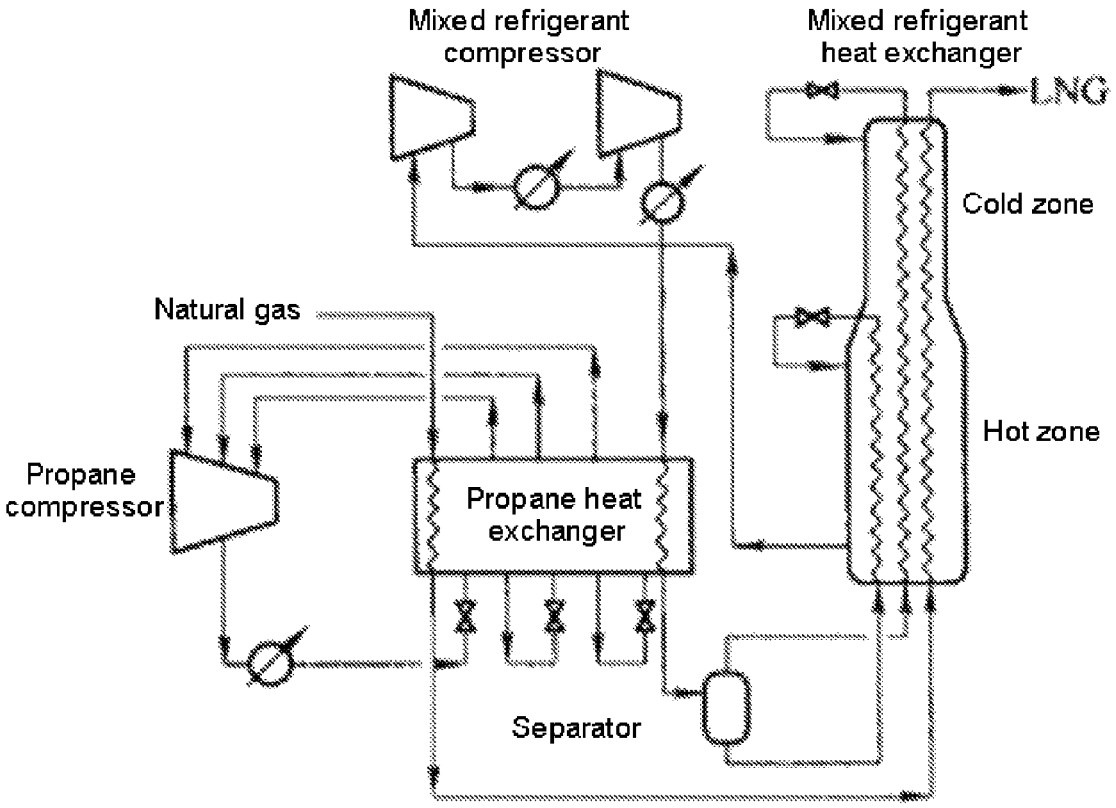
Prior Art Figure 2
FIG. 2 is a schematic diagram of APCI propane precooling mixed refrigerant liquefying process.
Figure 3:
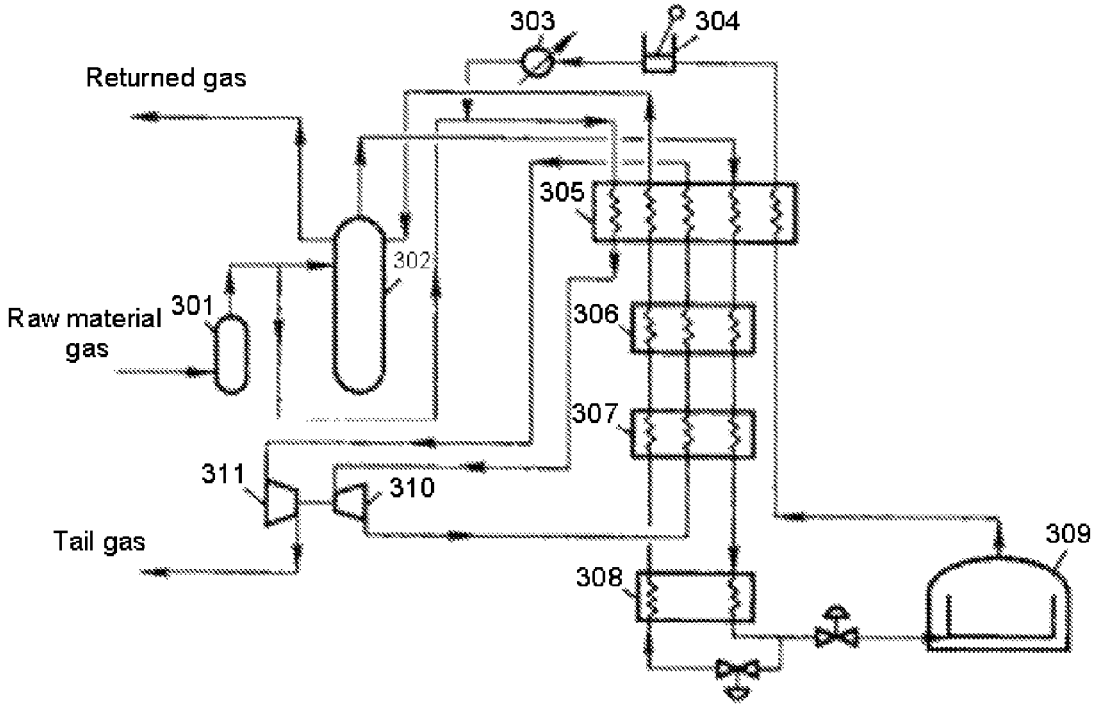
Prior Art Figure 3
FIG. 3 shows the natural gas expansion liquefying process.
Figure 4:
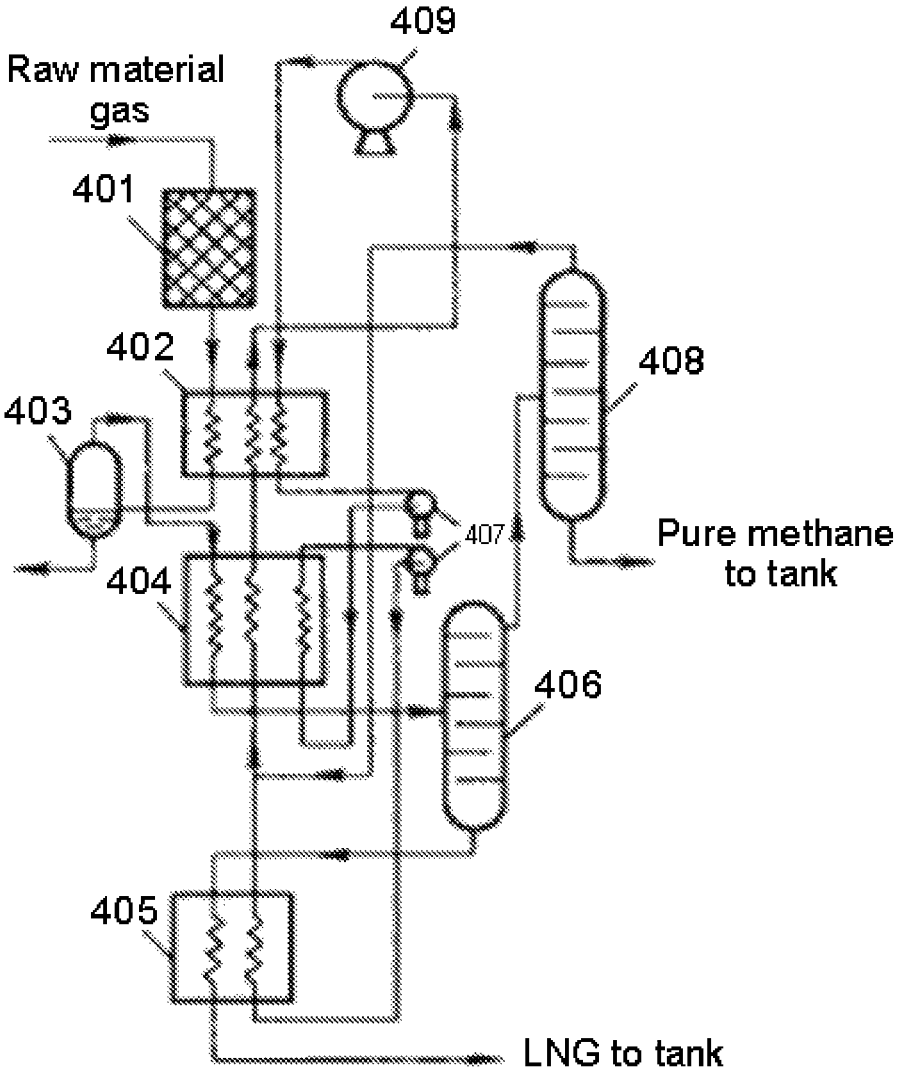
Prior Art Figure 4
FIG. 4 shows the nitrogen gas expansion liquefying process.
Figure 5:
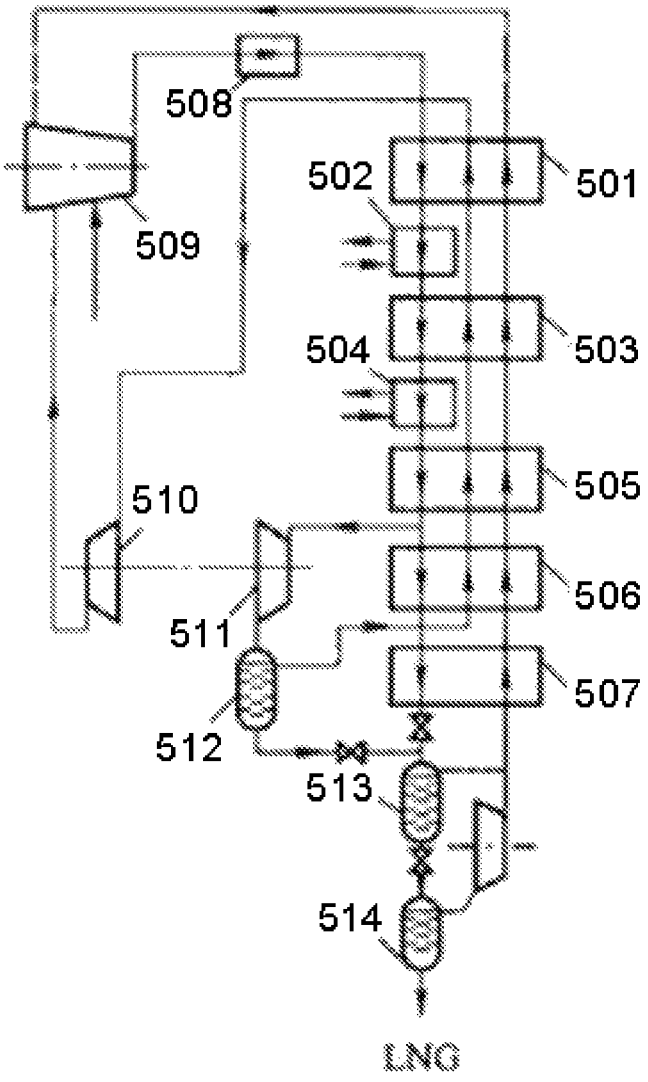
Prior Art Figure 5
FIG. 5 is a schematic diagram of natural gas expansion and liquefying process with propane precooling.
Figure 6:
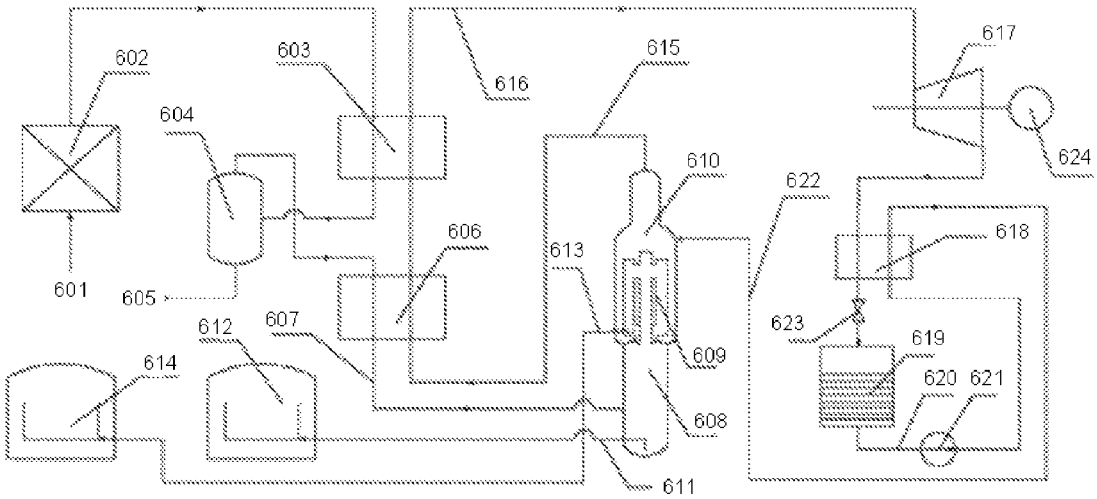
FIG. 6 is a schematic diagram of a natural gas isobaric liquefying apparatus of this invention.

As shown in FIG. 6, a natural gas isobaric liquefying apparatus, with nitrogen gas as refrigerant, with the specific embodiment as follows:

(1) The raw natural gas 601 flows via the pre-treatment apparatus 602 to remove moisture and carbon dioxide, enters the cold exchanger 603 and heavy hydrocarbon separator 604 to separate the liquid heavy hydrocarbon component 605, and then passes through cold exchanger 606 to become the precooled column feeding raw gas 607;

(2) The precooled column feeding raw gas 607 enters the lower column 608, flows via condensing evaporator 609 to produce supercooled methane liquid, which flows back for rectification and isobaric condensation to produce liquefied natural gas 611 or LNG 601, the LNG is sent to LNG tank 612;

(3) In the condensing evaporator, the pure methane liquid 613 produced from isobaric condensation is led to the liquid pure methane tank 614;

(4) The liquid refrigerant 620 from refrigerant tank 619 is made into a refrigerant gas-liquid mixture 622 via the cryogenic liquid pump 621 and cold regenerator 618, and enters the upper column 610, the condensing evaporator 609 condenses the methane gas in the lower column to produce liquid methane, the column outflow cryogenic refrigerant 615 from the upper column 610 flows via the cold exchanger 606 and cold exchanger 603 to cool down the raw natural gas 601, to form the refrigerant superheated vapor 616, which flows via the expander 617 to reduce pressure and temperature, and returns via cold regenerator 618 and throttle valve 623, to the refrigerant tank 619, the cold quantity required by the natural gas liquefying system is made up via condensing evaporator 609, cold exchanger 606 and cold exchanger 603, so as to form the cold dynamic cycle circuit of the refrigerant; the pressure of the cold makeup system can be conveniently regulated via throttle valve 623.

The braking equipment 624 of the said expander 617 is gas compressor, which is used to boost the raw natural gas.

The said refrigerant tank 619 is provided with necessary thermal and cold insulation, such as thermal isolated vacuum container, and insulation materials such as pearlite.

The equipment and their backup systems, pipes, instruments, valves, cold insulation and bypass facilities with regulation functions not described in this invention shall be configured with mature technologies of generally known traditional natural gas liquefying systems.

Safety and regulation and control facilities associated with the natural gas liquefying apparatus of this invention are provided, so that the apparatus can operate economically and safely with high thermal efficiency, to achieve the goal of energy conservation, consumption reduction and environmental protection.

This invention has been made public with an optimum embodiment as above, however, it is not used to restrict this invention, all variations or decorations made by those familiar with this technology without deviating from the spirit and scope of this invention also falls into the scope of protection of this invention. Therefore, the scope of protection of this invention shall be that defined by the claims in this application.

The invention claimed is:

1. A natural gas isobaric liquefaction apparatus, comprising:

a natural gas pretreatment system for removing moisture and $CO_2$ in the natural gas;

a refrigerant tank storing a liquid refrigerant;

a cryogenic liquid pump fluidly connected with an outlet of the refrigerant tank;

a cold regenerator having a first inlet for receiving the liquid refrigerant from the cryogenic liquid pump and a first outlet for outputting a stream of mixed gaseous and liquid refrigerant;

a liquefying system comprising a first chamber, a second chamber, a condensing evaporator fluidly connected to the second chamber, wherein the first chamber has an inlet for receiving the stream of mixed gaseous and liquid refrigerant from the cold regenerator and an outlet for outputting a low temperature refrigerant, the second chamber has an inlet fluidly connected with the natural gas pretreatment system and an outlet for outputting a liquefied natural gas, and wherein the condensing vaporizer cools the natural gas received from the second chamber to form the liquefied natural gas; and an expander having an inlet fluidly connected with the outlet of the first chamber and an outlet connected to a second inlet of the cold regenerator, wherein a second outlet of the cold regenerator is connected to an inlet of the refrigerant tank.

2. The apparatus of claim 1, further comprising: a throttle valve installed in a line connecting the second outlet of cold regenerator and inlet of the liquid refrigerant tank.

3. The apparatus of claim 1, wherein the expander comprises a braking equipment that is a fan, a motor, a hydraulic pump, or a gas compressor.

4. The apparatus of claim 2, wherein the expander comprises a braking equipment that is a fan, a motor, a hydraulic pump, or a gas compressor.

5. The apparatus of claim 1, wherein, in the liquefying system, the second chamber, the condensing evaporator (9), and the first chamber are integrated in one housing.

6. The apparatus of claim 2, wherein, in the liquefying system, the second chamber, the condensing evaporator, and the first chamber are integrated in one housing.

7. The apparatus of claim 3, wherein, in the liquefying system, the second chamber, the condensing evaporator (9), and the first chamber are integrated in one housing.

8. The apparatus of claim 4, wherein, in the liquefying system, the second chamber, the condensing evaporator (9), and the first chamber are integrated in one housing.

9. The apparatus of claim 1, wherein said refrigerant has a boiling point lower than or equal to that of methane under the standard atmospheric pressure, and is a mixture comprising one or more gases selected from methane, nitrogen, argon, helium, and hydrogen.

10. The apparatus of claim 1, further comprising one or two heat exchangers for precooling the natural gas prior to entering the liquefying system using the refrigerant from the outlet of the first chamber to the inlet of the expander.

* * * * *